US006678384B2

(12) United States Patent
Kowaki et al.

(10) Patent No.: US 6,678,384 B2
(45) Date of Patent: Jan. 13, 2004

(54) SPEAKER STRUCTURE

(75) Inventors: Hiroshi Kowaki, Kobe (JP); Hiroyuki Yoshii, Ikoma (JP)

(73) Assignees: Fujitsu Ten Limited, Hyogo (JP); Timedomain Corporation, Nara (JP)

( * ) Notice: Subject to any disclaimer, the term of this patent is extended or adjusted under 35 U.S.C. 154(b) by 37 days.

(21) Appl. No.: 09/876,859

(22) Filed: Jun. 6, 2001

(65) Prior Publication Data

US 2002/0021818 A1 Feb. 21, 2002

(30) Foreign Application Priority Data

Jun. 8, 2000 (JP) ..... 2000-177180

(51) Int. Cl.[7] ..... H04R 25/00

(52) U.S. Cl. ..... 381/182; 381/186; 381/386; 181/144; 181/179

(58) Field of Search ..... 381/87, 161–162, 381/182, 186, 335, 345, 349, 352–354, 386, 395, 396, 411; 181/151, 161, 166, 171, 179, 149, 144

(56) References Cited

U.S. PATENT DOCUMENTS

| | | | | |
|---|---|---|---|---|
| 1,667,251 A | * | 4/1928 | Fay et al. | 381/182 |
| 3,393,764 A | * | 7/1968 | Schafer | 381/182 |
| 4,083,426 A | | 4/1978 | Peugh | |
| 4,176,249 A | * | 11/1979 | Inanaga et al. | 381/182 |
| 4,783,820 A | | 11/1988 | Lyngdorf et al. | |
| 4,805,221 A | * | 2/1989 | Quaas | 381/161 |

FOREIGN PATENT DOCUMENTS

| | | |
|---|---|---|
| JP | 62-305408 | 6/1989 |
| JP | 5-153680 | 6/1993 |
| JP | 5-328473 | 12/1993 |
| JP | 6-326949 | 11/1994 |
| JP | 11-146471 | 5/1999 |

OTHER PUBLICATIONS

Corresponding European Patent Application Search Report, Dated Feb. 20, 2003.

Patent Abstract of Japan, Publication No. 01146471, Published on Jun. 8, 1999, in the name of Suga Akira.

Patent Abstract of Japan, Publication No. 05153680, Published on Jun. 18, 1993, in the name of Egawa Saburo.

Patent Abstract of Japan, Publication No. 05328473, Published on Dec. 10, 1993, in the name of Otsuka Isao.

Patent Abstract of Japan, Publication No. 06326949, Published on Nov. 25, 1994, in the name of Horiuchi Yasuo.

* cited by examiner

*Primary Examiner*—Curtis Kuntz
*Assistant Examiner*—Suhan Ni
(74) *Attorney, Agent, or Firm*—Christie, Parker & Hale, LLP

(57) ABSTRACT

A speaker structure having a simple configuration while maintaining good sound quality is disclosed. The speaker structure comprises a first speaker (20) having a first vibration plate (21), a first frame (22) for fixing the perimeter of the first vibration plate and a first magnetic circuit (24) for converting a signal into the vibration of the first vibration plate, a second speaker (30) having a second vibration plate (31), a second frame (32) for fixing the perimeter of the second vibration plate and a second magnetic circuit (34) for converting a signal into the vibration of the second vibration plate, and a fixing unit (50) for fixing the first magnetic circuit and the second magnetic circuit at their backs.

12 Claims, 6 Drawing Sheets

SPEAKER STRUCTURE

CROSS-REFERENCE TO RELATED APPLICATION

This application claims priority of Japanese patent Application No. 2000-177180, filed on Jun. 8, 2000.

BACKGROUND OF THE INVENTION

1. Field of the Invention

The present invention relates to a speaker structure.

2. Description of the Related Art

FIG. 7 is a section view of a prior art speaker structure. In FIG. 7, the reference numeral 100 denotes a box-style cabinet which is equipped with a speaker 200. The speaker 200 comprises a cone 201, a frame 202, a voice coil 203, a magnetic circuit 204, etc. The magnetic circuit 204 comprises a plate 205, a magnet 206, a yoke 207, etc. The speaker 200 is fixed at the front face of the cabinet 100 with screws 101.

In this prior art structure, vibration of the speaker is easily transmitted to the cabinet, and thereby an out-of-phase sound is generated by the cabinet. This is a cause of muddiness of the sound which is output from the speaker structure. In addition, when a sound is generated at the cone 201, reaction to the movement of the cone 201 arises on the yoke 207. Since the yoke 207 is apt to vibrate, the efficiency of energy transmission from the corn to air is low. This causes a bad transient characteristic of the sound (feeling of the sound speed) which is output from the speaker structure.

In order to solve such problems, speaker structures wherein a speaker is fixed at the front face of a cabinet, and a yoke of the speaker is supported directly by a supporting rod of the speaker structure, have been proposed in the patent applications of publications (Kokai) No. 11-146471 and No. 5-153680. However, due to low structural strength of these speaker structures, there has been such a problem that the speaker structure mounted in a car is broken due to the vibration of the car in motion. Increasing the strength of the speaker structure brings new problems such as increasing its weight and making its structure more complex.

SUMMARY OF THE INVENTION

It is an object of the present invention to provide a speaker structure with a simple configuration while maintaining good sound quality to solve the problems stated above.

In order to achieve the above object, the speaker structure comprises a first vibration plate, a first frame for fixing the perimeter of the first vibration plate, a first speaker having a first magnetic circuit for converting a signal to the vibration of the first vibration plate, a second vibration plate, a second frame for fixing the perimeter of the second vibration plate, and a second speaker having a second magnetic circuit for converting a signal to the vibration of the second vibration plate, and a fixing unit for fixing the first magnetic circuit and the second magnetic circuit at their backs.

In addition, it is preferable that the speaker structure has a means for supplying the same signals in phase to the first and the second magnetic circuits.

It is also preferable that the speaker structure has a cabinet for covering the first and second speakers, a supporting means for supporting the fixing unit, a shock absorber placed between the first frame and the cabinet, a shock absorber placed between the second frame and the cabinet, and a shock absorber placed between the supporting means and the cabinet, and thereby the cabinet is kept in floating state compared to the first and second speakers and the supporting means.

It is also preferable that the speaker structure has guides to be engaged with the edges of the cabinet, provided on the backs of the first and second frames.

It is also preferable that the speaker structure has a door unit provided on the cabinet.

It is also preferable that the fixing unit has a first rib fixed at the first magnetic circuit, a second rib fixed at the second magnetic circuit, and a connecting unit for connecting the first and the second ribs.

It is also preferable that the speaker structure has a intermediate supporter which is fixed at the fixing unit and has contact with the inner surface of the cabinet, and it is also preferable that the intermediate supporter is in contact with the inner surface of the cabinet via a shock absorber, and that a sound absorber is mounted on the intermediate supporter.

It is also preferable that the cabinet has an opening for air discharging.

DESCRIPTION OF THE PREFERRED EMBODIMENTS

Figure 1:
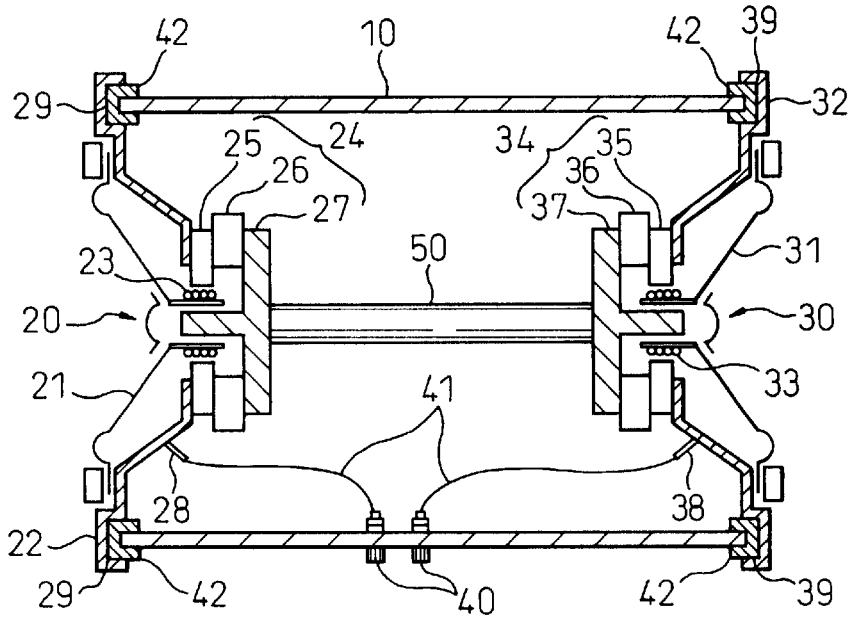
FIG. 1 is a drawing showing a speaker structure according to the first embodiment of the present invention.

Referring to the drawings, preferred embodiments of the present invention are described below.

FIG. 1 is a section view showing a speaker structure according to the first embodiment of the present invention. In FIG. 1, reference numeral 10 denotes a cylindrical hollow cabinet, and reference numerals 20 and 30 denote a speaker. The speaker 20 comprises a cone 21 which is a vibration plate, a frame 22 for fixing the perimeter of the cone 21, a voice coil 23 for vibrating the cone, a magnetic circuit 24, a terminal 28, etc. The magnetic circuit 24 comprises a plate 25, a magnet 26, yoke 27, etc. The speaker 30 comprises a cone 31, a frame 32, a voice coil 33, a magnetic circuit 34, a terminal 38, etc. The magnetic circuit 34 comprises a plate 35, a magnet 36, yoke 37, etc. It is preferable that the speaker 20 and 30 are completely identical in configuration and shape but they may have, at least, a cone with the same diameter, and a magnetic circuit with the same shape.

A rib 50 is fixed at a yoke 27 of the speaker 20 and a yoke 37 of the speaker 30 at their symmetrically opposed positions. Although the rib 50 is fixed at both yokes as shown in FIG. 1, the rib 50 may be fixed anywhere on the magnetic circuit. Thus the speaker 20 and the speaker 30 are coupled via the rib 50. The rib 50 comprises a cylindrical metal, etc., and it is preferable that the rib 50 does not have a constant cross sectional area throughout its length so that the rib 50 itself does not resonate. In other word, a so-called barrel-style rib is preferable which has small cross sectional area at the both ends connected to the yoke 27 and yoke 37, and large cross sectional area at the center part.

A guide 29 (39) is provided at the back of the perimeter of the frame 22 (32) for the speaker 20 (30). The cabinet 10 is so configured that it is engaged with the guides 29 and 39 via shock absorbers 42 at the entirety of both edges and is thus positioned. The shock absorbers 42 are placed between the speakers 20, 30 and the cabinet 10 to secure airtightness of the cabinet 10. The shock absorbers 42 also keep the speakers 20 and 30 in a floating state without fixing them to the cabinet. As stated above, the speakers 20 and 30 are kept in floating state compared to the cabinet 10, and thereby the vibrations of the speakers 20 and 30 are not transmitted to the cabinet 10 directly.

The shock absorbers 42 may be made of a material which at least has a cushion, keeps airtightness, and does not transmit the vibrations of the speakers 20 and 30 to the cabinet 10 directly. In addition, it is desired that the shock absorber is of a material which attenuates the signals of speakers 20 and 30 by 60 dB or more in their reproduction bandwidth. PEF is an example of such a material.

Signals such as audio signals are supplied to each speaker through an input terminal 40, a connecting wire 41, and terminals 28 and 38. It is preferable that the signals to be supplied to each speaker are the same signals in phase, and generate the same sound from each speaker at the same time. When the same signals in phase are supplied to each speaker, the reactions of each speaker, due to the vibrations of the yokes, are canceled out through the rib 50.

As stated above, two speakers are arranged back to back and connected via the rib, and thereby it is possible that the vibration of the yoke is suppressed efficiently and that the sound exchanging efficiency of the cone is increased. In addition, since each speaker is kept in floating state compared to the cabinet, it is possible that the vibration of the yoke is hardly transmitted to the cabinet, and that the ringing of the cabinet is reduced. It is also possible that the noise generated by the speakers is reduced.

If the two speakers are connected back to back without a rib, it is not possible to provide sufficient space in the cabinet, especially in the rear of each cone, and thereby there may be a problem that it is not possible to generate a good sound, and there may also be a problem that design flexibility is reduced. From the reasons stated above, it is important that the two speakers are fixed each other via a fixing unit comprising a rib, etc. allowing a space between the two speakers.

Figure 2:
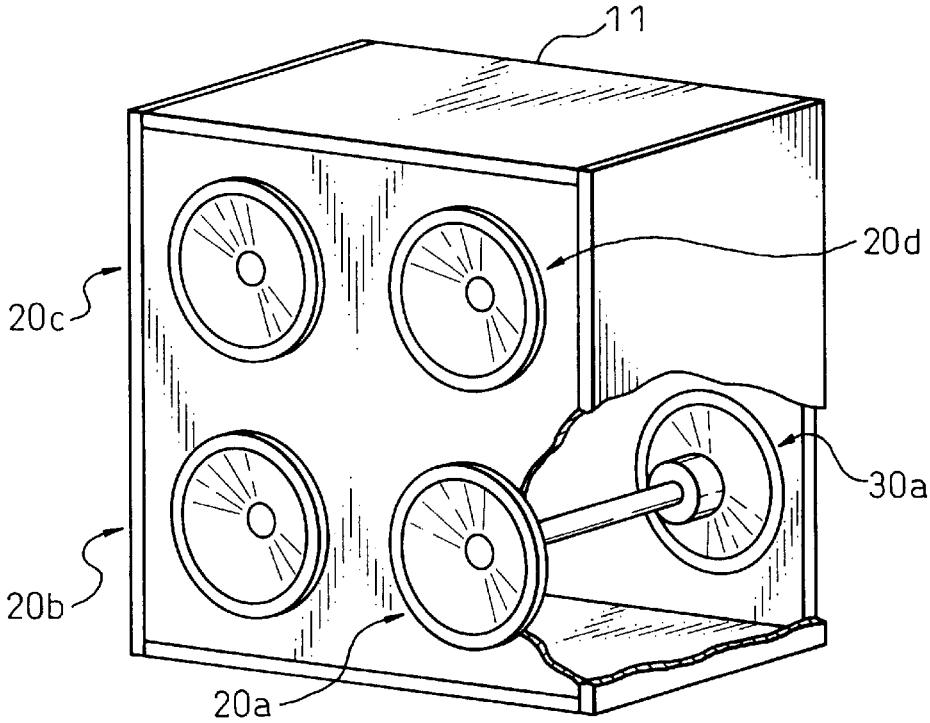
FIG. 2 is a drawing showing a speaker structure in which a plurality of the speaker structures shown in FIG. 1 are arranged in a single cabinet.

FIG. 2 illustrates an example of a speaker apparatus wherein four sets of speaker structures according to the first embodiment stated above are arranged in a single box-style cabinet 11. As illustrated in this figure, speakers 20*a*, 20*b*, 20*c* and 20*d* are arranged at the front side of the figure, and speakers 30*a*, 30*b*, 30*c* and 30*d* are arranged at the other side of the figure opposed to speakers 20*a*, 20*b*, 20*c* and 20*d* respectively. Each speaker illustrated in FIG. 2 is a small speaker having a cone diameter of 10 to 40 cm.

As stated above, multiple sets of pairs of speakers, which are fixed via a rib on their magnetic circuit, are mounted in the single cabinet, and thereby it is possible to raise the volume of reproduced low frequency sound while capitalizing on the low distortion characteristics of small speakers.

Figure 3:
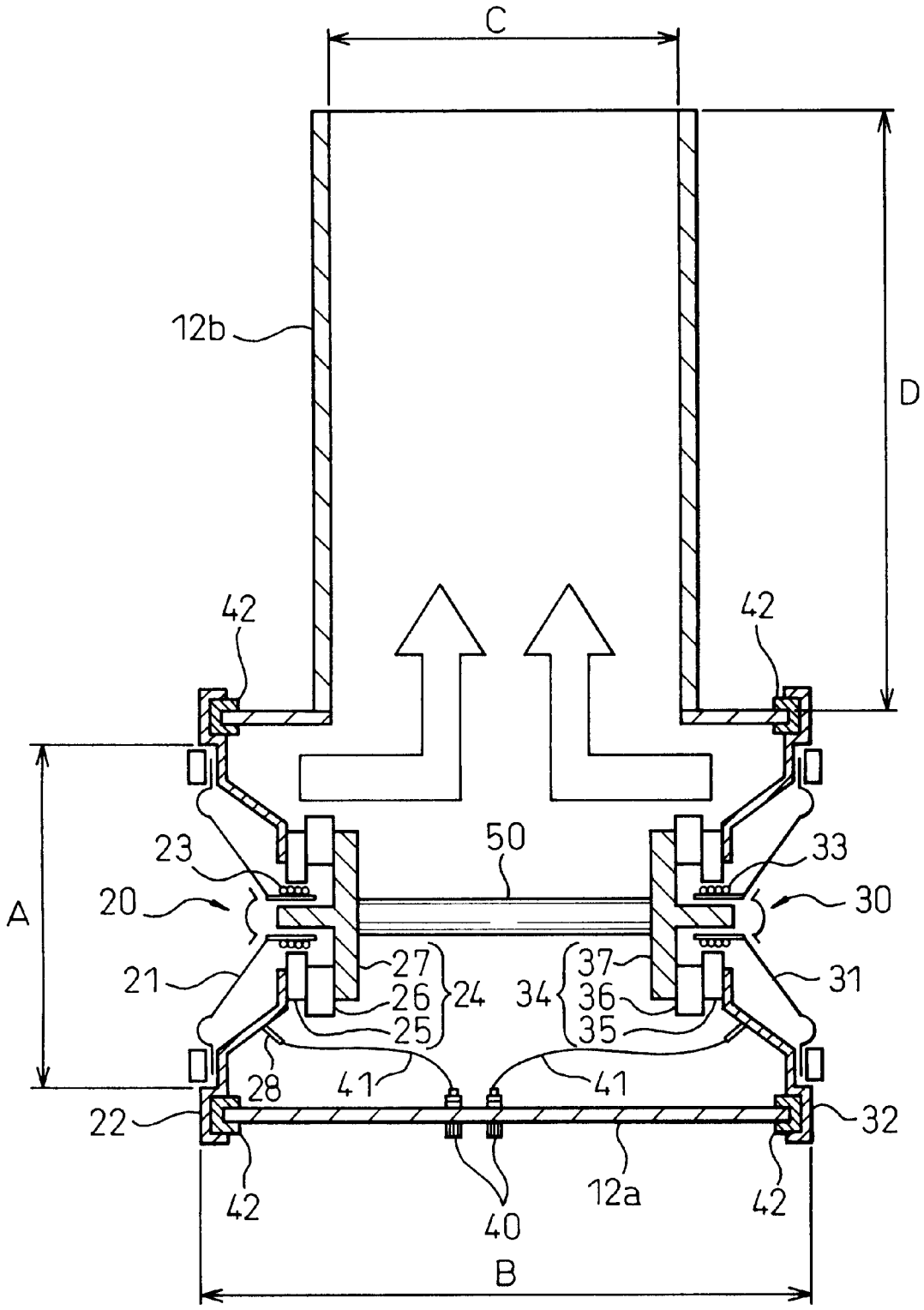
FIG. 3 is a drawing showing a speaker structure according to the second embodiment of the present invention.

FIG. 3 is a section view of a speaker structure according to the second embodiment of the present invention.

The second embodiment is a variation of the first embodiment, and only the shape of cabinet covering the two speakers 20 and 30 is different from the first embodiment. In the second embodiment, the cabinet comprises a cylindrical hollow body 12*a* similar to the cabinet 10 as shown in FIG. 1, and a cylindrical hollow projection part 12*b* projecting upward from the body 12*a*. The top end of the projection part 12*b* is open to let the air escape.

Regarding the dimensions of the projection part 12, for example, C=12 cm and D=100 cm is preferable in case of A=12 cm and B=20 cm, where, A is the diameter of the cones 21 and 31 of the speakers 20 and 30, B is the length of the body 12*a*, C is the diameter of the projection part 12*b*, and D is the length of the projection part 12*b*.

Since the top end of the projection part 12*b* is opened as shown in FIG. 3, the resonance frequency may be reduced by the opening, and thereby the ability for reproducing low frequency sound of the speaker may be improved.

Figure 4:
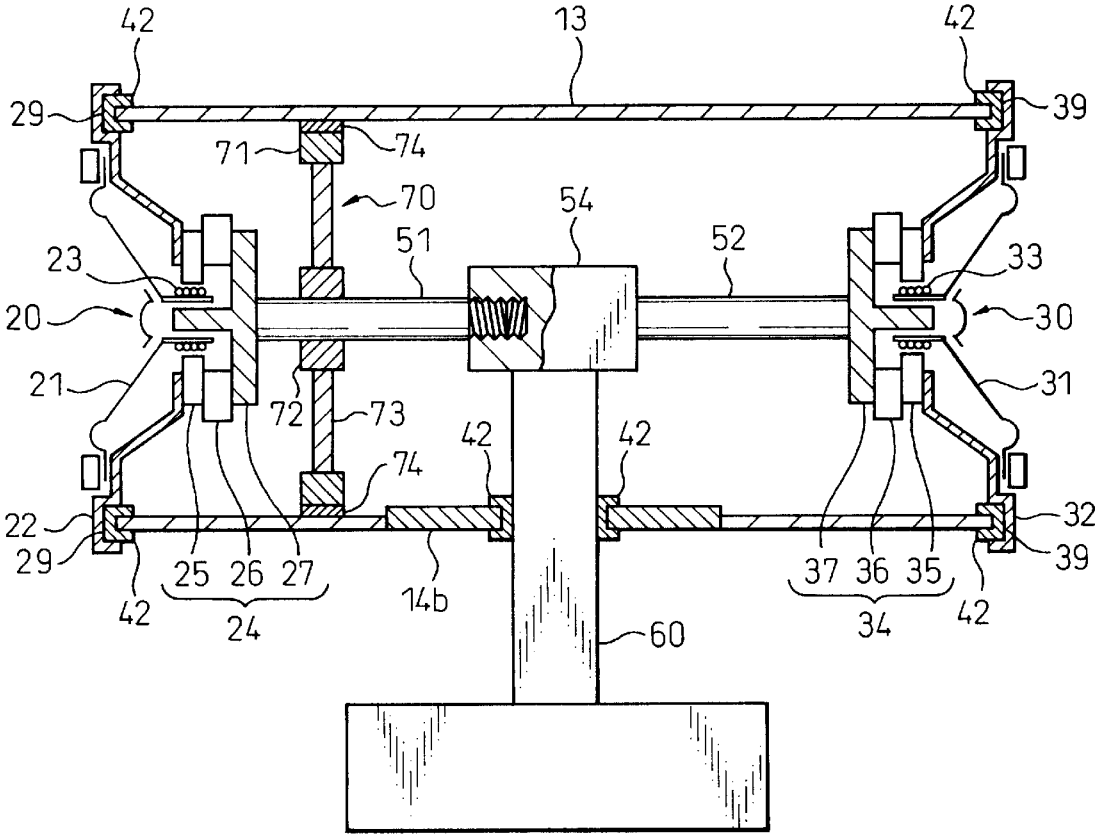
FIG. 4 is a drawing showing a speaker structure according to the third embodiment of the present invention.

FIG. 4 is a section view of a speaker structure according to the third embodiment of the present invention.

In FIG. 4, reference numeral 13 denotes a cylindrical hollow cabinet, and the reference numerals 20 and 30 denote a speaker similar to the speaker of the first embodiment.

One end of the rib 51 is fixed at the yoke 27 of the speaker 20. The other end of the rib 51 is threaded, thereby being connected to the connecting unit 54 by screwing. Likewise, one end of the rib 52 is fixed at the yoke 37 of the speaker 30, and the other end of the rib 52 is threaded, thereby being connected to the connecting unit 54 by screwing.

One end of the rib 51 and one end of the rib 52 are fixed at yokes 27 and 37 respectively as shown in FIG. 4, but may be fixed at any parts of the magnetic circuits 24 and 34 respectively. Thus, the speaker 20 and the speaker 30 are coupled via the rib 51, the rib 52 and the connecting unit 54. The ribs 51 and 52 comprises cylindrical metal, etc, and it is preferable that the ribs 51 and 52 do not have a constant cross sectional area throughout their length so that they do not resonate by themselves. The connecting unit 54 is fixed at a stand 60. Furthermore, it is preferable that the ribs 51 and 52 are fixed, at the magnetic circuits 24 and 34 respectively, at their symmetrically opposed center positions, and thereby it is possible to reduce the resonance of the ribs 51 and 52.

Figure 5:
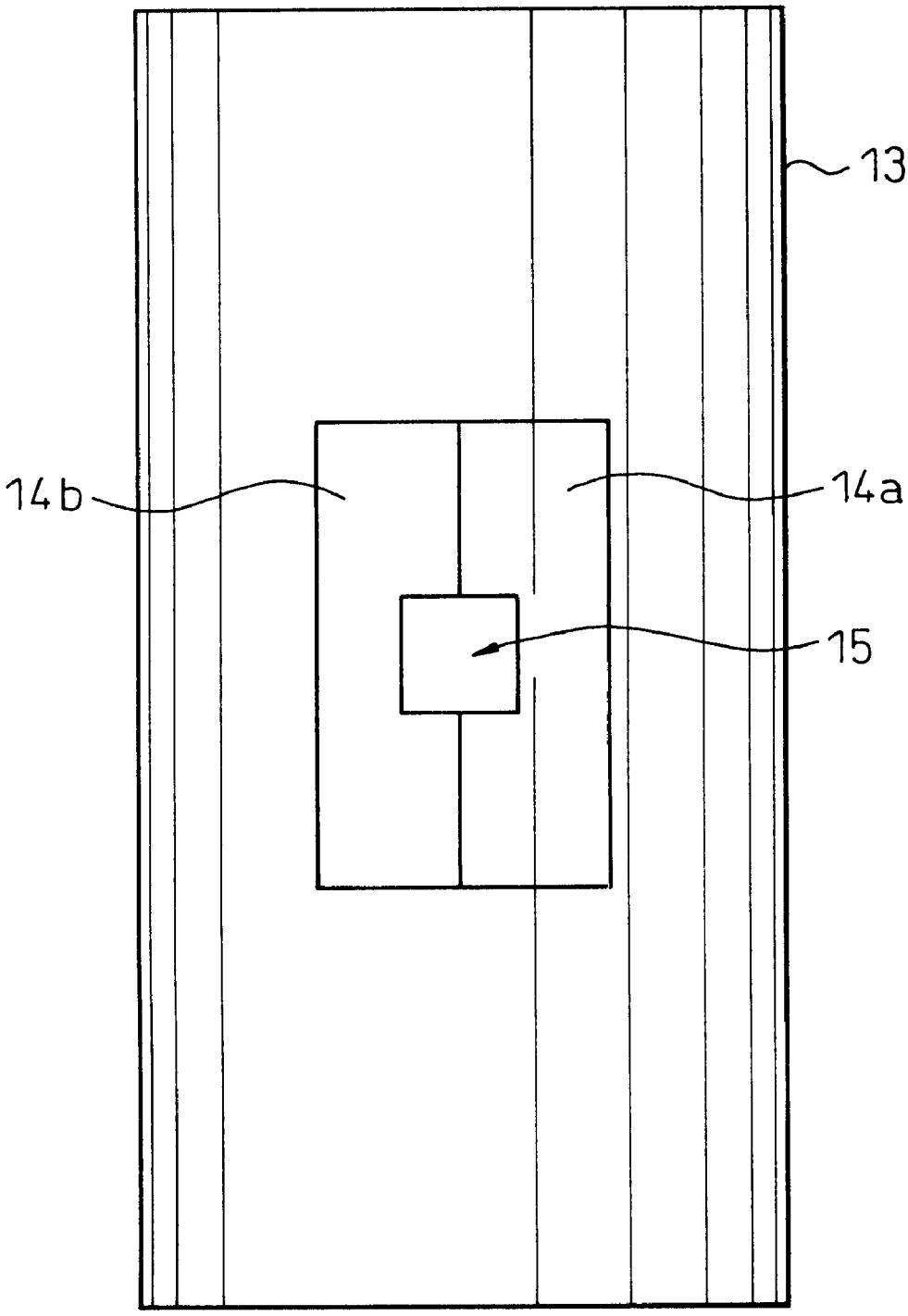
FIG. 5 is a plan view of the cabinet 13.

FIG. 5 is a bottom view of the cabinet 13. The speaker 20 is mounted at the lower part of the figure, and the speaker 30 is mounted at the upper part of the figure. An opening 15 for the stand 60 is provided at the bottom of the cabinet, and doors 14*a* and 14*b* are provided around the opening. The doors 14*a* and 14*b* are mounted on the cabinet 13 by means of hinges so as to be opened from side to side frontward in the figure. Opening the doors 14*a* and 14*b* makes mounting the stand 60 to the connecting unit 64 and wiring inside the cabinet easy.

The entire edges of the cabinet 13 are positioned by the frames 22 and 32 of speakers, and the shock absorbers 42. And also a shock absorber 42 is placed between the doors 14*a*, 14*b* of the cabinet 13 and the stand 60. These shock absorbers 42 secure airtightness of the cabinet 10, and keep the cabinet 13 in floating state compared to the speakers 20 and 30, and also to the stand 60. As stated above, the cabinet 13 is kept in floating state compared to the speakers 20 and 30 and to the stand 60, and thereby vibrations of the speakers 20 and 30 are not transmitted to the cabinet 13 directly. The materials and so on of the shock absorbers 42 are similar to ones for the first embodiment aforementioned.

Figure 6:
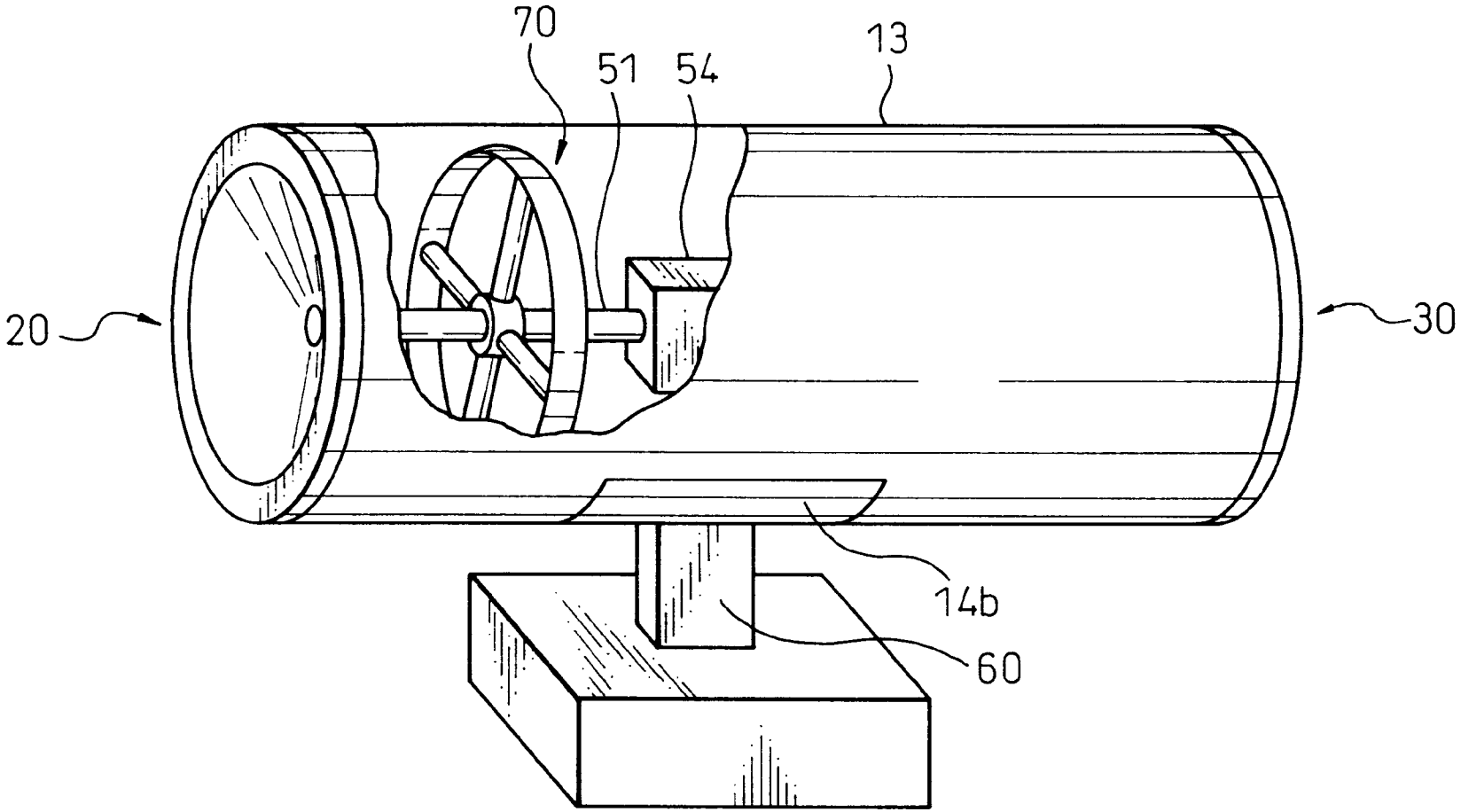
FIG. 6 is a perspective view of the speaker structure shown in FIG. 4.
Figure 7:
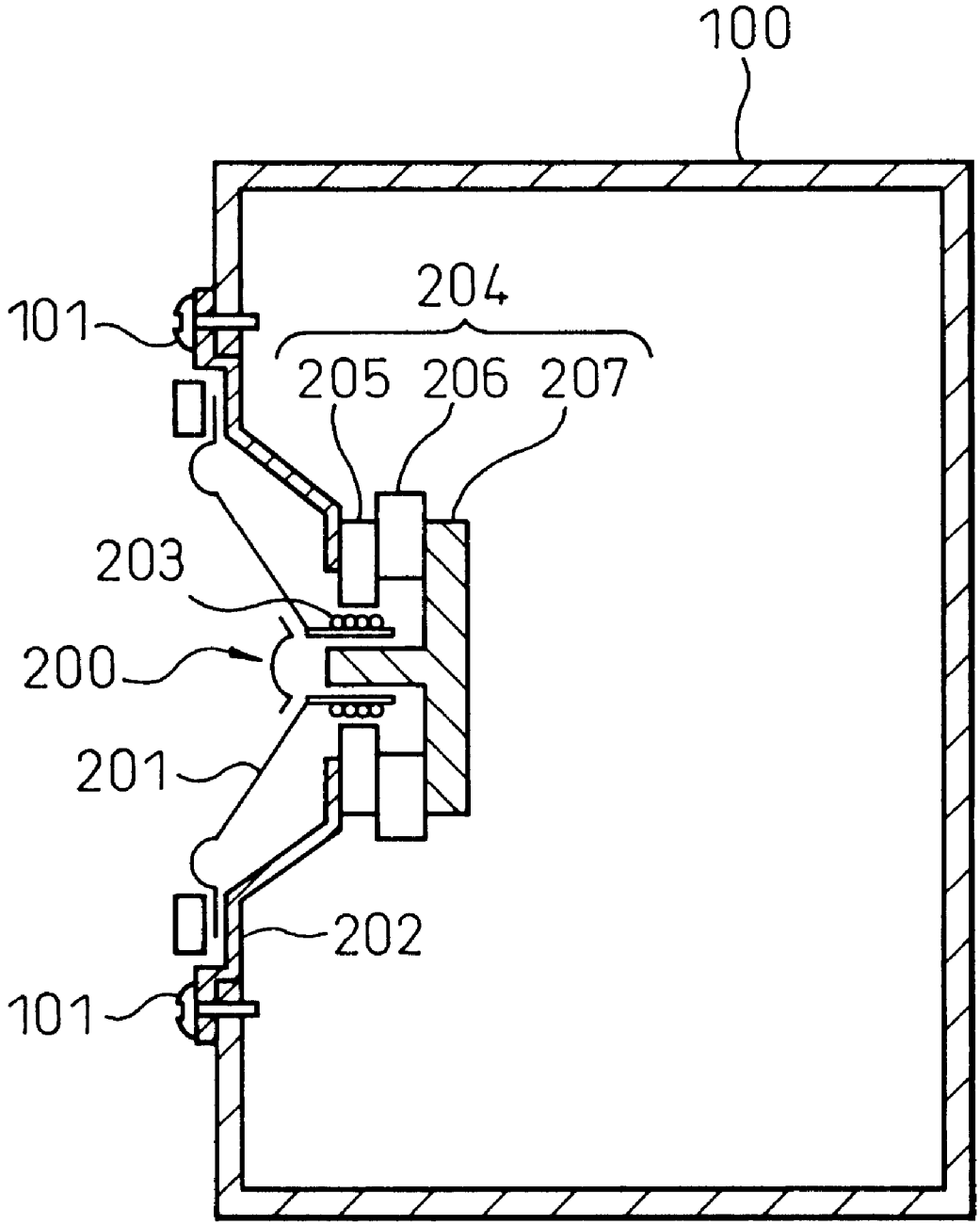
Fig. 7 PRIOR ART
FIG. 7 is a drawing showing a prior art speaker structure.

Additionally, a intermediate supporter 70 is provided inside the cabinet 13 to stabilize the rib 51. The intermediate supporter 70 comprises a ring 71, a base 72 fixed at the rib 51, columns 73 for fixing the ring 71 and the base 72, and a shock absorber 74. The intermediate supporter 70 is in contact with the inner wall of the cabinet 13 via the shock absorber 74. FIG. 6 is a perspective view showing the inside of the cabinet. According to FIG. 6, it can be understood how the intermediate supporter 70 is fixed at the rib. Using this intermediate supporter 70, the relative position of the rib 51 to the cabinet 13 may be kept constant, and the rib may be stabilized accordingly. Felt or the like is suitable for the material of the shock absorber 74. In addition, it is preferable to wrap a sound absorber such as glass fiber around the columns 73. The intermediate supporter 70 is fixed at only the rib 51 as shown in FIG. 4, but a similar intermediate supporter may be provided for the rib 52.

Signals such as audio signal are supplied to each speaker through a input terminal, a connecting wire, and terminals, as in the first embodiment, which are not shown in FIG. 4. It is preferable, as in the first embodiment, that signals to be supplied to each speaker are the same signals in phase, and generate the same sound from each speaker at the same time. When the same signals in phase are supplied to each speaker, reactions of each speaker due to the vibration of the cones are canceled out through the ribs 51 and 52, and connecting unit 54.

An example of how to assemble the speaker structure according to the third embodiment is described below. First, the rib 51 fixed at the speaker 20 is fixed to the connecting unit 54 by screwing. Then, the guide 29 of the speaker 20 is engaged with a end of the cabinet 13 via the shock absorber 42. After that, the speaker 30 and the rib 52 fixed at the speaker 30 are inserted from the other end of the cabinet 13 in such a way that the rib 52 is screwed into the connecting unit 54. Then the rib 52 is fixed to the connecting unit 54 by screwing in such a way that the guide 39 of the speaker 30 is engaged with the other end of the cabinet 13 via the shock absorbers 42. After the above procedures, the speakers 20 and 30 are secured by the ribs 51 and 52, and the connecting unit 54, and the cabinet 13 is positioned between the guides of the speakers 20 and 30.

After that, the doors 14*a* and 14*b* of the cabinet are opened, and the stand 60 is inserted through the opened the doors, and then connecting unit 54 is fixed to the stand 60. Furthermore, predetermined wiring for each speaker is carried out. Lastly, the doors 14*a* and 14*b* are closed in such a way that the shock absorber 42 is positioned between the doors 14*a*, 14*b*, and the stand 60. According to the above procedures, the speaker structure of the third embodiment is assembled.

As stated above, the two speakers are fixed to each other via fixing devices including ribs allowing spacing between the two speakers, and thereby it is possible that the vibration of the yoke is suppressed efficiently and the sound exchanging efficiency of the cone is increased.

When the same signals in phase are supplied to the two speakers, the forces by which the yokes of the speakers push or pull each other are canceled out and, thereby, the vibration of the yoke is suppressed efficiently.

In addition, when each speaker is kept in a floating state compared to the cabinet, the vibrations of the yokes are hardly transmitted to the cabinet and the abnormal sound of the cabinet is reduced. The noise generated by the speakers are is also reduced.

Furthermore, the speaker structure is so configured that it is assembled while pulling both speakers by the connecting unit 54, thereby may be steady regardless of the vibration during transportation.

What is claimed is:

1. A speaker structure comprising:

a first speaker having a first vibration plate, a first frame for fixing the perimeter of said first vibration plate and a first magnetic circuit for converting a signal to the vibration of the first vibration plate;

a second speaker having a second vibration plate, a second frame for fixing the perimeter of the second vibration plate and a second magnetic circuit for converting a signal to said vibration of the second vibration plate;

a fixing unit for fixing said first magnetic circuit and said second magnetic circuit at their backs;

a cabinet for covering said first and second speakers;

a supporting means for supporting said fixing unit; and a shock absorber placed between said first frame and said cabinet, between said second frame and said cabinet, and between said supporting means and said cabinet, wherein said cabinet is kept in a floating state compared to said first and second speakers and said supporting means.

2. The speaker structure of claim 1, further comprising:

guides to be engaged with the edges of said cabinet, provided on the backs of said first and second frames.

3. The speaker structure of claim 1, further comprising:

a door unit provided on said cabinet.

4. The speaker structure of claim 1, further comprising an intermediate supporter which is fixed at said fixing unit and is in contact with an inner surface of said cabinet.

5. The speaker structure of claim 4, wherein said intermediate supporter is in contact with said inner surface of said cabinet via a shock absorber.

6. The speaker structure of claim 4, wherein a sound absorber is mounted on said intermediate supporter.

7. The speaker structure of claim 1, wherein said cabinet has an opening for discharging air.

8. The speaker structure of claim 1, further comprising means for supplying a drive signal to the first magnetic circuit and the second magnetic circuit, wherein the drive signal supplied to the first magnetic circuit is in phase with the drive signal supplied to the second magnetic circuit.

9. A speaker structure comprising:

a first speaker having a first vibration plate, a first frame for fixing the perimeter of said first vibration plate and a first magnetic circuit for converting a signal to the vibration of the first vibration plate;

a second speaker having a second vibration plate, a second frame for fixing the perimeter of the second vibration plate and a second magnetic circuit for converting a signal to said vibration of the second vibration plate;

a fixing unit for fixing said first magnetic circuit and said second magnetic circuit at their backs;

wherein said fixing unit has a first rib fixed at the back of said first magnetic circuit, a second rib fixed at the back of said second magnetic circuit, and a connecting unit for connecting said first and second ribs.

10. The speaker structure of claim 9, further comprising means for supplying a drive signal to the first magnetic circuit and the second magnetic circuit, wherein the drive signal supplied to the first magnetic circuit is in phase with the drive signal supplied to the second magnetic circuit.

11. A speaker structure comprising:

a plurality of speaker pairs, wherein one or more of said speaker pairs comprises, a first speaker having a first vibration plate, a first frame for fixing the perimeter of said first vibration plate and a first magnetic circuit for converting a signal to the vibration of the first vibration plate;

a second speaker having a second vibration plate, a second frame for fixing the perimeter of the second vibration plate and a second magnetic circuit for converting a signal to said vibration of the second vibration plate;

a fixing unit for fixing said first magnetic circuit and said second magnetic circuit at their backs;

a cabinet for covering said first and second speakers;

a supporting means for supporting said fixing unit; and a shock absorber placed between said first frame and said cabinet, between said second frame and said cabinet, and between said supporting means and said cabinet, wherein said cabinet is kept in a floating state compared to said first and second speakers and said supporting means.

12. A speaker structure comprising:

a plurality of speaker pairs, wherein one or more of said speaker pairs comprises, a first speaker having a first vibration plate, a first frame for fixing the perimeter of said first vibration plate and a first magnetic circuit for converting a signal to the vibration of the first vibration plate;

a second speaker having a second vibration plate, a second frame for fixing the perimeter of the second vibration plate and a second magnetic circuit for converting a signal to said vibration of the second vibration plate;

a fixing unit for fixing said first magnetic circuit and said second magnetic circuit at their backs;

wherein said fixing unit has a first rib fixed at the back of said first magnetic circuit, a second rib fixed at the back of said second magnetic circuit, and a connecting unit for connecting said first and second ribs.

* * * * *

UNITED STATES PATENT AND TRADEMARK OFFICE

CERTIFICATE OF CORRECTION

PATENT NO. : 6,678,384 B2
DATED : January 13, 2004
INVENTOR(S) : Kowaki et al.

It is certified that error appears in the above-identified patent and that said Letters Patent is hereby corrected as shown below:

Title page,
Item [56], References Cited, FOREIGN PATENT DOCUMENTS, delete
"JP 62-305408 6/1989" insert -- JP 01-146471 6/1989 --.
OTHER PUBLICATIONS, delete
"Patent Abstract of Japan, Publication No. 01146471, Published on June 8, 1999", insert
-- Patent Abstract of Japan, Publication No. 01146471, Published on June 8, 1989 --.

Signed and Sealed this

Eighth Day of November, 2005

JON W. DUDAS
*Director of the United States Patent and Trademark Office*